US006349921B1

(12) United States Patent
Jahrling

(10) Patent No.: US 6,349,921 B1
(45) Date of Patent: Feb. 26, 2002

(54) INSTITUTIONAL FLUSH VALVE OPERATING SYSTEM

(75) Inventor: Peter J. Jahrling, Park Ridge, IL (US)

(73) Assignee: Sloan Valve Company, Franklin Park, IL (US)

( * ) Notice: Subject to any disclaimer, the term of this patent is extended or adjusted under 35 U.S.C. 154(b) by 0 days.

(21) Appl. No.: 09/609,676

(22) Filed: Jul. 3, 2000

(51) Int. Cl.[7] ..... E03D 5/10
(52) U.S. Cl. ..... 251/129.04; 4/406; 4/DIG. 15
(58) Field of Search ..... 251/129.03, 129.04, 251/129.15, 129.19; 4/302, 305, 313, 406, 410, DIG. 3, DIG. 15

(56) References Cited

U.S. PATENT DOCUMENTS

| | | | | |
|---|---|---|---|---|
| 4,041,557 A | | 8/1977 | Ringler | 4/DIG. 15 X |
| 4,195,374 A | | 4/1980 | Morris et al. | 4/DIG. 15 X |
| 4,203,173 A | | 5/1980 | Morris et al. | 4/DIG. 15 X |
| 4,381,022 A | | 4/1983 | Medynski | 4/DIG. 3 X |
| 4,434,516 A | | 3/1984 | Morris et al. | 4/DIG. 15 X |
| 4,471,498 A | | 9/1984 | Robertshaw | 4/302 |
| 4,616,368 A | | 10/1986 | Nagai et al. | 4/305 X |
| 4,631,760 A | | 12/1986 | Leishman et al. | 4/313 X |
| 4,793,588 A | | 12/1988 | Laverty, Jr. | 251/30.03 |
| 4,985,944 A | | 1/1991 | Shaw | 4/313 X |
| 5,125,621 A | * | 6/1992 | Parsons et al. | 4/406 X |
| 5,235,706 A | | 8/1993 | Allen et al. | 4/302 |
| 5,244,179 A | * | 9/1993 | Wilson | 251/30.03 |
| 5,313,673 A | | 5/1994 | Saadi et al. | 4/313 |
| 5,331,619 A | | 7/1994 | Barnum et al. | 4/DIG. 15 X |
| 5,431,181 A | | 7/1995 | Saadi et al. | 251/129.04 X |
| 5,699,994 A | * | 12/1997 | Wu | 251/129.03 |
| 5,771,501 A | | 6/1998 | Shaw | 4/313 |
| 6,018,827 A | * | 2/2000 | Shaw et al. | 4/406 X |
| 6,019,343 A | * | 2/2000 | Tsai | 251/129.03 X |
| 6,056,261 A | * | 5/2000 | Aparicio et al. | 251/129.03 |

FOREIGN PATENT DOCUMENTS

| | | | | |
|---|---|---|---|---|
| GB | 2 165 271 A | * | 4/1986 | 4/DIG. 15 |

* cited by examiner

*Primary Examiner*—Alan N. Shoap
*Assistant Examiner*—Eric Keasel
(74) *Attorney, Agent, or Firm*—Cook, Alex, McFarron, Manzo, Cummings & Mehler, Ltd.

(57) ABSTRACT

A toilet room flush valve for use in connection with urinals or water closets includes a body having a water inlet and a water outlet. There is a valve seat in the body between the inlet and outlet and a valve member is movable toward and away from the valve seat to control the flow of water through the valve body. An electric actuator is mounted on the valve body for causing movement of the valve member. There is a first opening in the valve body and a movable valve element extends in through the first opening into the interior of the valve body. A manually movable member, accessible from outside the valve body is used to cause movement of the valve element within the interior of the valve body. There is a second opening in the valve body and an electronic sensor positioned within the interior of the valve body for detecting movement of the movable valve element and an electrical lead which is connected to the electronic sensor and extends through the second valve body opening. The electrical lead is connected, through control circuitry, to the electric actuator whereby sensed movement of the movable valve element will affect controlled operation of the actuator and consequent movement of the valve member to operate the flush valve.

11 Claims, 1 Drawing Sheet

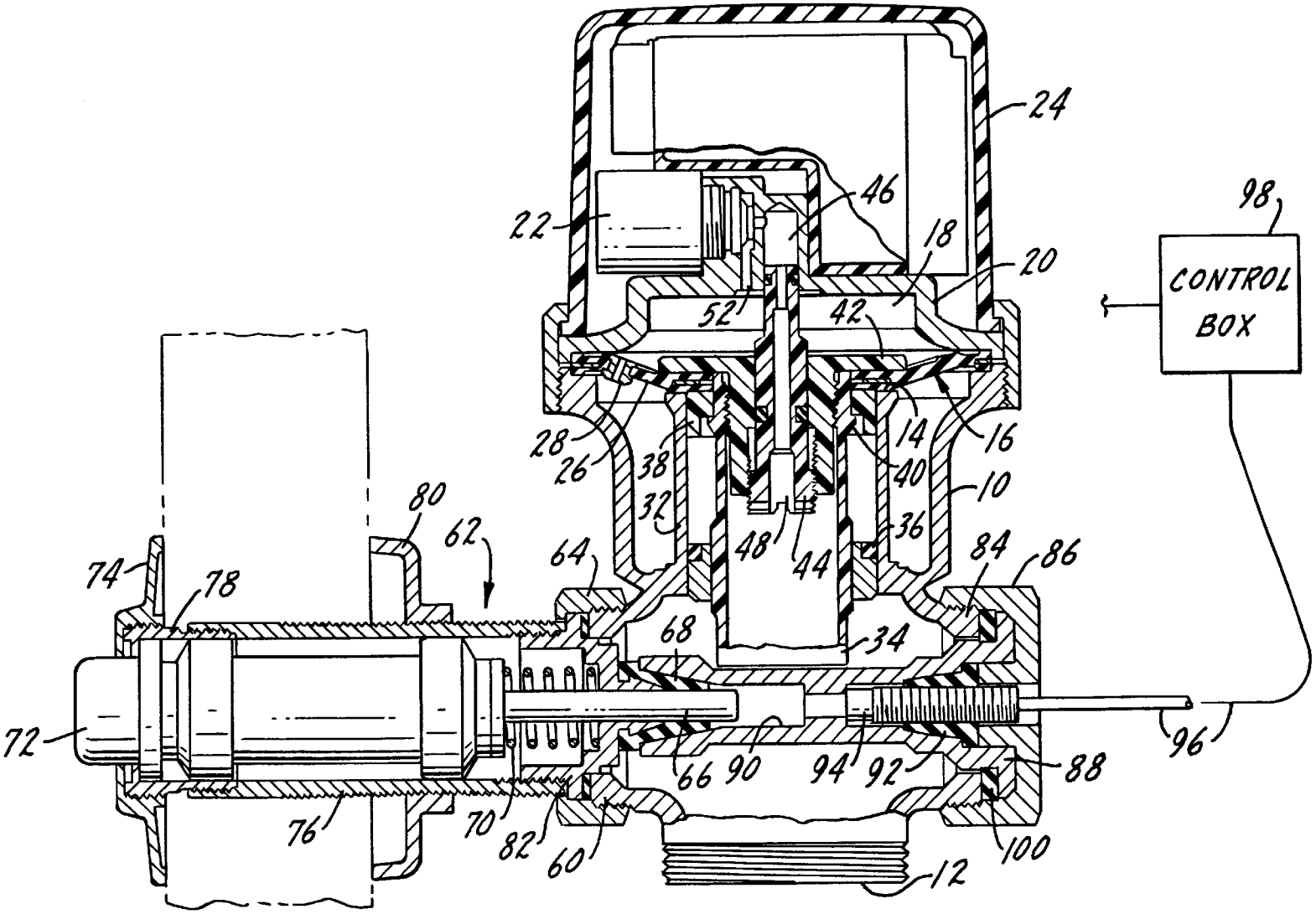
CONTROL BOX
98
96
24
20
16
10
84
86
88
100
12
18
14
40
36
34
92
46
42
44
94
48
52
90
66
68
38
32
28
26
64
60
22
82
70
62
80
76
78
74
72

INSTITUTIONAL FLUSH VALVE OPERATING SYSTEM

THE FIELD OF THE INVENTION

The present invention relates to a toilet room flush valve for use on urinals and water closets and more specifically to such a flush valve suitable for use in institutions, such as a prison. In a prison environment it is not unknown for those persons having urinals or water closets in their living quarters to cause unnecessary operation of a flush valve. This is not only wasteful of water, but is a subtle form of vandalism. The present invention provides a manual button for use by an individual to signal that a flush valve should be operated. Movement of this manual element is detected by an electronic sensor and provides a signal to an electrical control. The electrical control decides when and how often the flush valve will actually be operated and will cause operation of an electrical actuator on the flush valve.

The present invention specifically allows a totally manual fixture to be retrofitted for electronic operation without the necessity of re-piping the supply and vacuum breaker tubes which are normally connected to the flush valve. The purpose of the present invention is to easily convert a manual prison or institutional flush valve to an electronically activated flushometer in which electronics are used to process an input actuating signal, resulting from a manual operation, allowing the institution to program restrictions to flushing the fixture.

The present invention is particularly advantageous in that the existing flush valve body can be used and no water lines need to be broken or removed from the installed fixture. Existing flush valve bodies in this type of installation have two openings, one of which provides for the manual operating lever or push button currently being used. The other opening will provide access for an electronic sensor which will detect movement of the plunger actuated by the push button. The detection of this movement in turn will be electrically connected to a control circuit which in turn will determine when the electric actuator in the flush valve body will be utilized.

SUMMARY OF THE INVENTION

The present invention relates to flush valves for use in operating toilets, water closets and urinals and more specifically to flush valves for use in an institutional or prison environment.

The invention is specifically directed to a flush valve which may be retrofitted, without any change in water connections, from totally manual operation to a hybrid electrical/manual operation.

Another purpose of the invention is to provide a flush valve for the described environment in which there is an electronic sensor to detect manual actuation of the flush valve, with the electronic sensor being connected to an electrical control circuit which controls operation of the flush valve through an electrical actuator.

Other purposes will appear in the ensuing specification, drawings and claims.

DESCRIPTION OF THE DRAWINGS

The invention is illustrated diagrammatically in the attached drawing which is a section through a flush valve of the present invention.

DESCRIPTION OF THE PREFERRED EMBODIMENT

The present invention relates to flush valves for use in connection with urinals and toilets and more specifically to a flush valve arrangement suitable for institutional use.

More particularly, the invention described herein has application in prisons in which there is a need to control use of the flush valve to prevent both vandalism and excessive water consumption. It is present practice for flush valves to be accessible by prison inmates from within their cell and there is a manual control for use by such individuals to flush the toilet or urinal. In order to avoid the excessive use of these devices, there is a clear need to control the number of times the flush valve may be operated in response to manual actuation by an individual. The present invention provides a retrofit to existing flush valves which are used in such an environment which will enable the flush valve to be changed from a pure manual operation to what may be termed a hybrid manual/electrical operation. This change may be brought about by replacing a portion of the existing valve operating components, but without affecting the water inlet and outlet pipes which are connected to the valve body. Since the flush valve is often located behind a partition, the ability to make this change without affecting the water connections is extremely important.

In the drawings, a flush valve body is indicated at 10 and has an outlet for 12 and an inlet connection, not shown, but conventional in valve assemblies of this type such as, for example, shown in U.S. Pat. No. 5,244,179 owned by Sloan Valve Company of Franklin Park, Ill., the assignee of the present application. The disclosure of the '179 patent is herein incorporated by reference.

The body 10 has a valve seat 14 which is closed by a diaphragm assembly indicated generally at 16. The diaphragm assembly, again which may be more fully disclosed in the '179 patent is held in position upon the valve seat 14 through a volume of water contained within a pressure chamber 18. The upper portion of the pressure chamber is defined by an inner cover 20 upon which will be positioned a solenoid 22 which will affect operation of the flush valve. The solenoid 22 is located within an outer cover 24.

The diaphragm assembly 16 includes a diaphragm 26 having a bypass 28 whereby inlet water may flow into the pressure chamber 18. There is a guide 34 centered in the valve body throat 32 by a flow control ring 36. A refill ring 38 is positioned at the upper end of guide 34 and is mounted on an outwardly extending shelf 40 of the guide 34. A piston disc 42 is threaded to the inside of guide 34 and is used to attach the assembly of the guide and refill ring to the diaphragm 26. These elements all move in unison as the diaphragm moves between open and closed positions of the valve. The diaphragm assembly is completed by a piston screw 44 which is threaded to the inside of piston disc 42 and extends upwardly into a bore 46 in inner cover 20. Piston screw 44 contains a passage 48 which is in communication with the valve outlet 12 for relief of chamber 18 when the valve is operated.

The solenoid 22 is mounted on top of inner cover 20 and controls water flow from chamber 18 through a passage 52 in inner cover 20 and into bore 46 in the inner cover.

Thus, the solenoid controls the venting of pressure chamber 18 through passages 52, 48 and bore 46 to the outlet 12 of the flush valve.

Valve body 10 has a first side opening 60 to which is attached a pushbutton assembly indicated generally at 62 by means of a coupling nut 64. The assembly 62 includes a plunger 66 which extends into the interior of the valve body 10 and is surrounded by a seal 68. A spring 70 holds the plunger 66 in a normally retracted position. The plunger is operated by a pushbutton 72 which extends outwardly through a wall flange 74. Typically, there will be a wall separating the pushbutton from the valve assembly. A socket 76 forms a connection between a collar 78, mounting flange 74, and a locknut 80, which will be positioned on the concealed side of the divider wall. Operation of pushbutton 72 is effective to move the plunger 66 in an inward direction, against the retracting force of spring 70. The pushbutton assembly 62 is held onto the valve body 10 by coupling nut 64 and a bushing 82.

Directly opposite the opening 60 in the valve body 10 is a second opening 84 which holds a sensor assembly. The sensor assembly may include a mounting nut 86, holding a tube 88, with the tube extending generally into the valve body 10 and defining a chamber 90 for movement of the plunger 66. There is a seal 92 which surrounds an electronic sensor 94 also positioned within the tube 88. The electronic sensor 94 will detect inward movement of the plunger 66 and this detected movement will provide an electrical signal over wire lead 96 to a control box 98. The sensor subassembly is completed by a washer seal 100.

The tube 88 provides a sealed environment for the electronic sensor 94 to detect movement of the plunger 66 and the seals 68 and 92 prevent the entrance of water into that environment.

There is a connection from the control box 98 to the solenoid 22 and the operation of the solenoid will be controlled by the electronic logic within the control box. There are various process controls which are suitable for use in the control box 98 which will regulate operation of the solenoid and thus functioning of the flush valve. For example, there may be one operation of the flush valve for every 2, 3 or 4 operations of the pushbutton 72 or there may be a time based system or it may be otherwise. What is important is that operation of the pushbutton is detected by the electronic sensor 94 and the fact of pushbutton operation is communicated to the control box 98 which then in turn, will control operation of the solenoid as desired to both conserve water and insure that the flush valve only operates as needed.

Of particular importance in the invention is the fact that the flush valve body 10 may be a standard valve body which is used for manual operation and both the openings 60 and 84 are present in such a valve body. The valve itself may be operated by a diaphragm as shown, or it could be otherwise. If a diaphragm valve is to be used, then the manual diaphragm assembly is replaced by the described solenoid operated assembly without any need to change the valve body and the water inlet and outlet connections thereto. Similarly the pushbutton assembly, normally used in a manually operated valve of this type can remain. It is only necessary to add the proximity sensor and the solenoid and associated components along with the control box 98 to completely change a manually operated valve into one which is manually/electrically operated.

Whereas the preferred form of the invention has been shown and described herein, it should be realized that there may be many modifications, substitutions and alterations thereto.

What is claimed is:

1. A toilet room flush valve for use in connection with urinals or water closets including a body having a water inlet and a water outlet, a valve seat in said body between said inlet and outlet, a valve member movable toward and away from said valve seat to control the flow of water through said valve body, an electric actuator on said valve body for causing movement of said valve member, a first opening in said valve body, a movable valve element extending into said first opening and into the interior of said valve body, manual means accessible from outside said valve body for moving said valve element within the interior of said valve body, a second opening in said valve body, an electronic sensor positioned within the interior of said valve body to detect movement of said movable valve element within said valve body, an electrical conduit connected to said electronic sensor and extending through said second valve body opening, and electrical control means connected to said conduit and said electric actuator whereby sensed movement of said movable valve element within said valve body will affect controlled operation of said actuator and consequent movement of said valve member to operate said flush valve.

2. The flush valve of claim 1 including a tube within said valve body, said valve element being movable within said tube, and said sensor being positioned within said tube.

3. The flush valve of claim 2 wherein said first and second openings are in alignment and said tube extends from one opening toward the other.

4. The flush valve of claim 3 wherein said tube extends from said second opening toward said first opening.

5. The flush valve of claim 4 including seal means, within said valve body, and sealing said tube from water flowing within said valve body.

6. The flush valve of claim 1 wherein said movable valve element is a plunger.

7. The flush valve of claim 6 wherein said manual means for moving said plunger include a pushbutton mounted to the exterior of said valve body.

8. The flush valve of claim 6 including a seal positioned within said valve body and extending about said plunger.

9. The flush valve of claim 1 wherein said electric actuator is a solenoid mounted on said valve body above said valve member.

10. The flush valve of claim 1 wherein said valve member is a flexible diaphragm movable toward and away from said valve seat.

11. The flush valve of claim 10 including a pressure chamber located above said valve member in said valve body, operation of said actuator venting said pressure chamber permitting movement of said diaphragm away from said valve seat.

* * * * *